United States Patent [19]

Tordonato

[11] Patent Number: 4,637,455

[45] Date of Patent: Jan. 20, 1987

[54] SUPPORT RACK FOR TUBES IMMERSED IN A FLUIDIZED BED

[75] Inventor: Sebastian Tordonato, West Hartford, Conn.

[73] Assignee: Combustion Engineering, Inc., Windsor, Conn.

[21] Appl. No.: 656,052

[22] Filed: Sep. 28, 1984

[51] Int. Cl.[4] ..... F28C 3/16; F28F 9/00

[52] U.S. Cl. ..... 165/104.16; 34/57 A; 422/146; 165/162; 122/510

[58] Field of Search ..... 165/104.16, 162; 34/57 A; 422/146; 122/4 D, 510

[56] References Cited

U.S. PATENT DOCUMENTS

| | | | |
|---|---|---|---|
| 2,759,710 | 8/1956 | Paille | 422/146 |
| 3,545,537 | 12/1970 | Hill, Jr. | 122/510 |
| 3,820,594 | 6/1974 | Ritland et al. | 165/162 |
| 4,270,599 | 6/1981 | Connell | 165/104.16 |
| 4,359,088 | 11/1982 | Jabsen | 122/510 |

FOREIGN PATENT DOCUMENTS

| | | | |
|---|---|---|---|
| 26759 | of 1896 | United Kingdom | 122/510 |

*Primary Examiner*—Albert W. Davis, Jr.
*Attorney, Agent, or Firm*—David L. Smith

[57] ABSTRACT

A hot support rack (46) for supporting an in-bed heat exchanger (44) of a fluidized bed furnace (22) is comprised of a plurality of support bars (54, 56) disposed diagonally between spaced vertical support posts (58). The support bars (54, 56) form a criss-cross array of quadrangular openings through which the tubes (44) of in-bed heat exchanger (44) pass with each tube (44) passing through a quadrangular opening being supported by the upper surface of the lower bars (54, 56) forming the quadrangular opening.

10 Claims, 10 Drawing Figures

SUPPORT RACK FOR TUBES IMMERSED IN A FLUIDIZED BED

BACKGROUND OF THE INVENTION

The present invention relates to fluidized bed combustion and in particular to apparatus for supporting a tubular heat exchanger immersed in a fluidized bed.

In present fluidized bed combustion systems, the feed solids are typically discharged through nozzles or openings located in or above the fluidized bed. Combustion air serves as fluidizing air and is supplied to an air plenum located beneath the fluidized bed. The fluidizing air passes upwardly from the air plenum into the fluidized bed through a perforated bed support plate at a flow rate sufficiently high to fluidize the feed solids within the fluidized bed. The feed solids are comprised of sulfur oxide sorbent and sulfur containing carbonaceous fuel. Combustion occurs in the fluidized bed and in the freeboard region above a bed. The combustion flue gases exit the freeboard region through the top of the fluidized bed furnace. A heat exchanger within the fluidized bed as well as the tubular walls containing the fluidized bed transfer thermal energy due to combustion to a working fluid passing through the heat exchanger and tubular panel walls.

In a typical fluidized bed furnace having a pneumatic transport feed system, discharge nozzles are located near the bottom of the fluidized bed above the bed support plate. The feed solids are supplied to the fluidized bed in pneumatic transport air and released into the bed at the discharge nozzles. The bed engulfs the in-bed heat exchanger and the bed bubbling dynamics create an additional load on the heat exchanger that is transmitted to the heat exchanger support rack.

Prior art non-working fluid cooled in-bed heat exchanger support racks often failed under these operating conditions necessitating using working fluid cooled supports. It is an object of the present invention to provide a hot (not working fluid cooled) support system for an in-bed heat exchanger that will transmit the load on the heat exchanger to the rack supports without failing.

SUMMARY OF THE INVENTION

In accordance with the present invention, a hot support system for supporting a tubular in-bed heat exchanger that transmits the load thereon to the rack support is disclosed. The hot support system is comprised of a plurality of support bars disposed diagonally between spaced upright support posts so as to form a criss-cross array of openings through which the in-bed heat exchanger tubes pass. A first plurality of spaced substantially parallel support bars extend diagonally upward forming a substantially vertical first plane. A second plurality of spaced substantially parallel bars extend diagonally downward forming a substantially vertical second plane spaced from and parallel to the first plane forming a criss-cross array of substantially quadrangular openings as viewed normal to the first and second planes. Each quadrangular opening is formed by two support bars of the first plurality and two support bars of the second plurality with a tube passing through a quadrangular opening supported by the lower support bar of the first plurality and the lower support bar of the second plurality. Vertical support posts are provided between the first and second planes between tubes of the in-bed heat exchanger where the support bars intersect to carry the load to the base thereof.

DESCRIPTION OF THE PREFERRED EMBODIMENT

Figure 2:
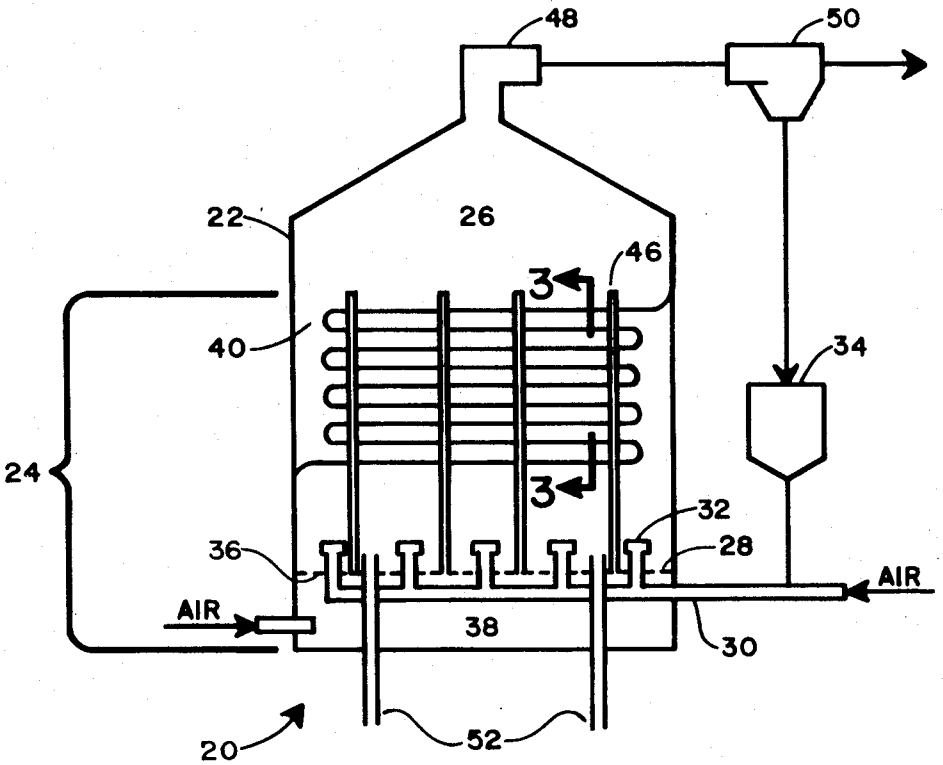
FIG. 2 is a diagrammatic representation of a fluidized bed system incorporating the hot support rack of the present invention.

Referring to the drawing, there is depicted a fluidized bed system 20, including an in-bed heat exchanger supported by a hot support rack of the present invention, as best seen in FIG. 2. The walls of fluidized bed furnace 22 are tube banks having a working fluid passing therethrough. Within fluidized bed furnace 22, fluidized bed chamber 24 is located beneath freeboard region 26. The fluidized bed chamber 24 is divided into a combustion region above bed support plate 28 and a fluidizing air inlet region below bed support plate 28. Crushed sulfur containing carbonaceous fuel is supplied to fluidized bed furnace 22 through fuel transport line 30 and discharge nozzles 32. The crushed fuel may be temporarily. stored in bin 34 until it is supplied to fluidized bed furnace 22 through a transport feed system either under the bed or over the bed. The fluidizing air is supplied to fluidized bed chamber 24 beneath bed support plate 28 and passes upwardly through air ports 36 in perforated bed support plate 28 into the fluidized bed. Perforated bed support plate 28 functions to support the fluidized bed and provide a partition between the fluidizing air emission zone 38 and fluidized bed 40. The upward velocity of the fluidizing air through air ports 36 is greater than the terminal velocity of the bed solids so as to prevent the bed solids from gravitating into the air emission zone 38 during operation of fluidized bed furnace 22.

Combustion occurs in fluidized bed 40 generating thermal energy that is removed from fluidized bed 40 by the walls of fluidized bed furnace 22 and in-bed heat exchanger 42. in-bed heat exchanger 42, supported by hot support racks 46, is primarily used for generating steam. During combustion, the fluidized bed engulfs in-bed heat exchanger 42 generating varying mechanical loads in addition to the weight of the heat exchanger and working fluid passing therethrough that must be carried by hot support rack 46. As the fuel is consumed in fluidized bed 40, the particle size decreases and the smaller particles become light enough to be carried out of fluidized bed 40 into freeboard region 26. Some of the entrained fuel particles will fall back into fluidized bed 40 while others become completely consumed within freeboard region 26. The remaining small portion of particles entrained in the combustion flue gas, along with other particulate matter such as flyash are carried out of fluidized bed furnace 22 through gas outlet 48.

The flue gas passing through gas outlet 48 is passed through a particulate filter. The particulate filter separates entrained particulate matter from the flue gas so that the particulate matter may be recycled back into fluidized bed furnace 22. Typically, a particulate filter 50, such as a cyclone separator, is disposed in the flue gas steam leaving fluidized bed furnace 22 to remove the particulate matter entrained therein and recycle the particulate matter back to fluidized bed 40.

A bed drain system is provided to maintain bed height at a preselected level and to continuously or periodically purge the fluidized bed 40 of any unnecessary material such as ash particles and spent sulfur oxide sorbent. A plurality of bed drain pipes 52 pass through or around air emission zone 38 and extend upwardly into fluidized bed 40 thereby providing a flow passage communicating between fluidized bed 40 and the outside of fluidized bed furnace 22 through which the bed drain material can be removed.

Figure 1:
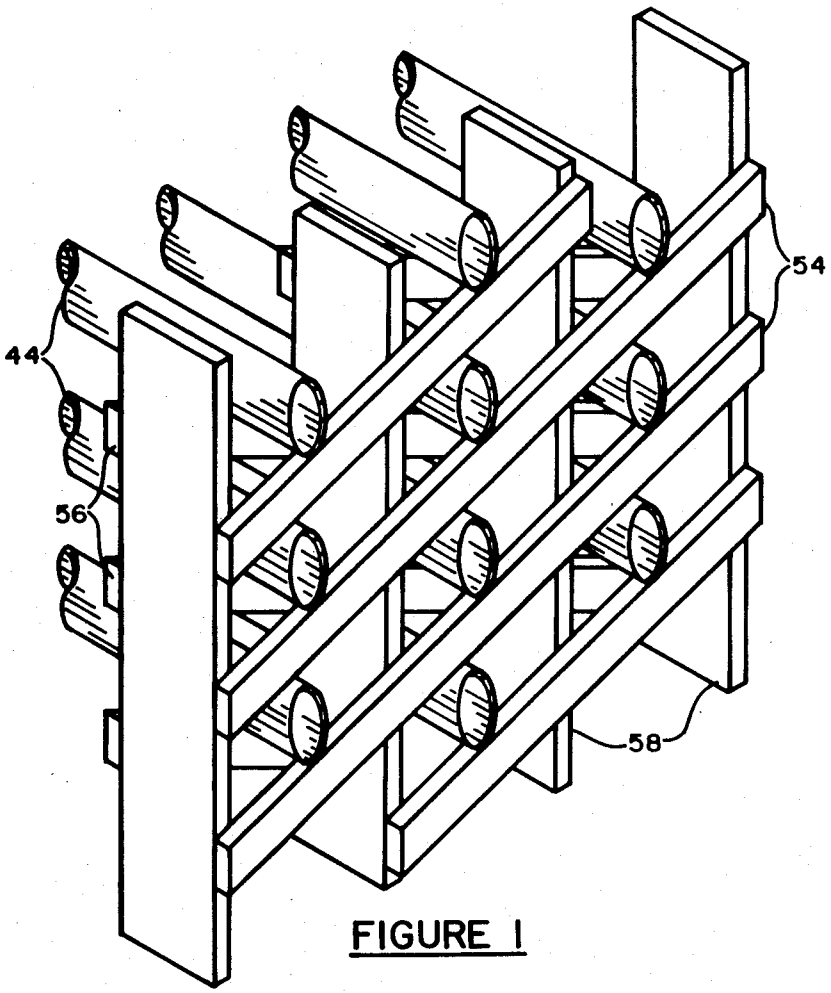
FIG. 1 is an isometric view of the hot support rack of the present invention.

The varying load on the in-bed heat exchanger support rack is transmitted to the base of support rack 46. An isometric view of the hot support rack of the present invention as shown as FIG. 1. Hot support rack 46 is comprised of a plurality of spaced substantially parallel bars extending diagonally upward in a substantially vertical plane and forming an acute angle with respect to the vertical. The intermember spacing between adjacent bars, in a preferred embodiment, is at least as great as the outside diameter of a tube 44 of tubular in-bed heat exchanger 42, and preferably slightly larger than the outside diameter so as to allow for thermal expansion of tubing 44 of in-bed heat exchanger 42.

A plurality of spaced substantially parallel support bars 56 disposed diagonally downward form a substantially vertical plane spaced from and parallel to the plane of support bars 54. The intermember space of support bars 54 and support bars 56 as viewed normal to the planes of support bars 54 and support bars 56 form a criss-cross array of openings through which tubes 44 of in-bed heat exchanger 42 pass. The intermember space forms a quadrangular opening through which tubes 44 of in-bed heat exchanger 42 pass with each tube supported by one of support bars 54 and one of support bars 56. The angle between support bars 54 and vertical may but need not be the same as the angle between support bars 56 and vertical; these angles will vary depending on spacing of tubes 44 but will generally be acute with respect to vertical.

Figure 3:
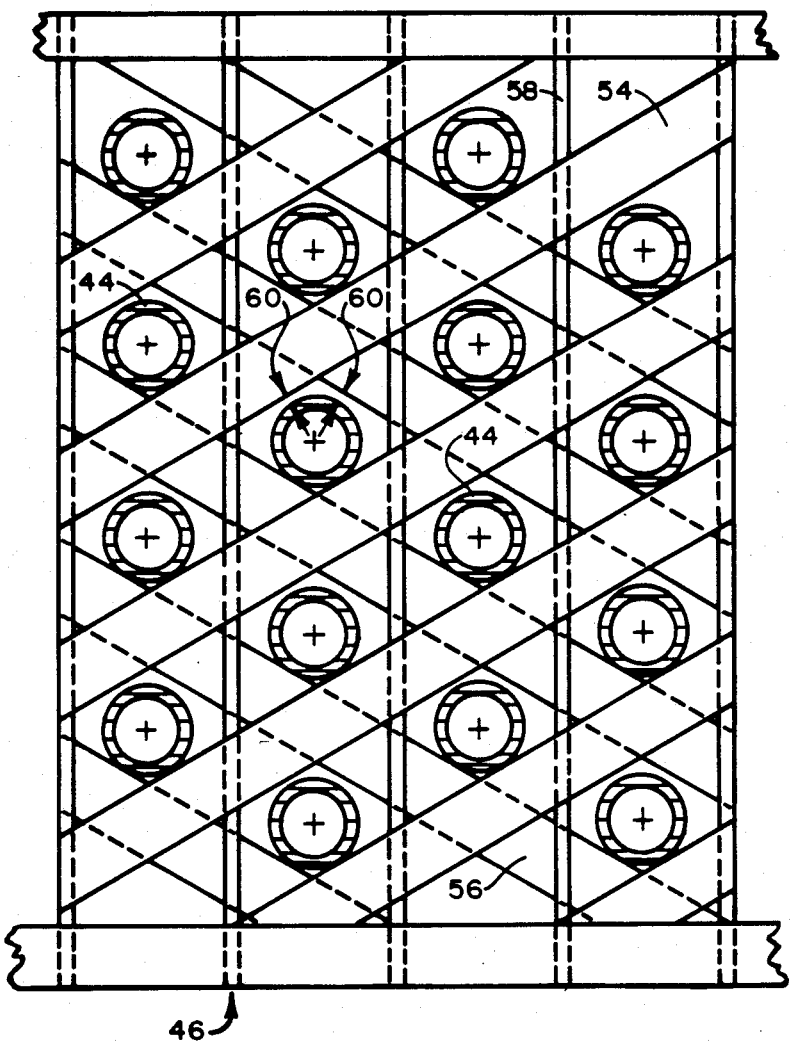
FIG. 3 is a cross-section of the in-bed heat exchanger taken along the lines 3—3 of FIG. 2.
Figure 5:
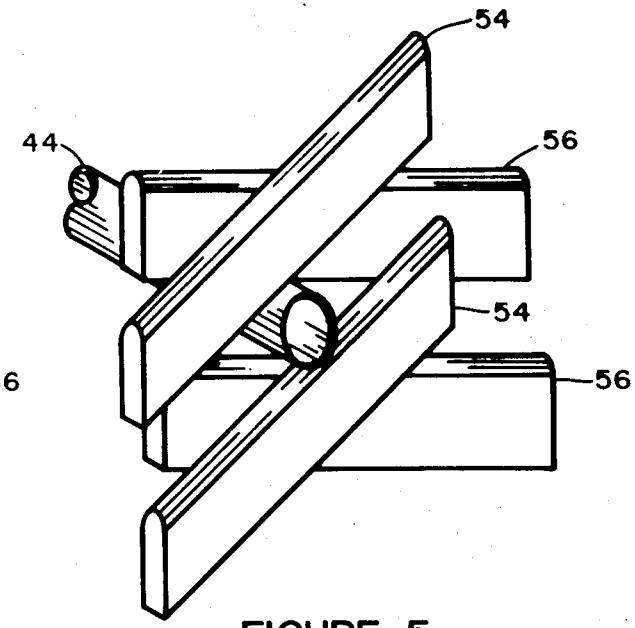
FIG. 5 is an isometric view of a portion of the hot support rack showing rounded support bars.

Upright support posts 58 are disposed between the quadrangular openings in the region where diagonally upward support bars 54 and diagonally downward support bars 56 intersect as viewed normal to the planes thereof as best seen in FIG. 3. Each tube 44 of in-bed heat exchanger 42 is supported by one of support bars 54 in each hot support rack 46 and also by one of support bars 56 at a distance equivalent to the spacing between the plane of support bars 54 and support bars 56. The interplane spacing is substantially the depth of vertical support posts 58 as support bars 54 and support bars 56 are welded at their intersection with vertical support posts 58. In this manner, the weight of tubes 44 as well as the working fluid passing therethrough and in addition any loading due to the bubbling fluidized bed on tubes 44 is transferred to support bars 54 and 56 thence to vertical support posts 58 which transfer the load to a support, not shown, at the base of vertical support posts 58.

Figure 4:
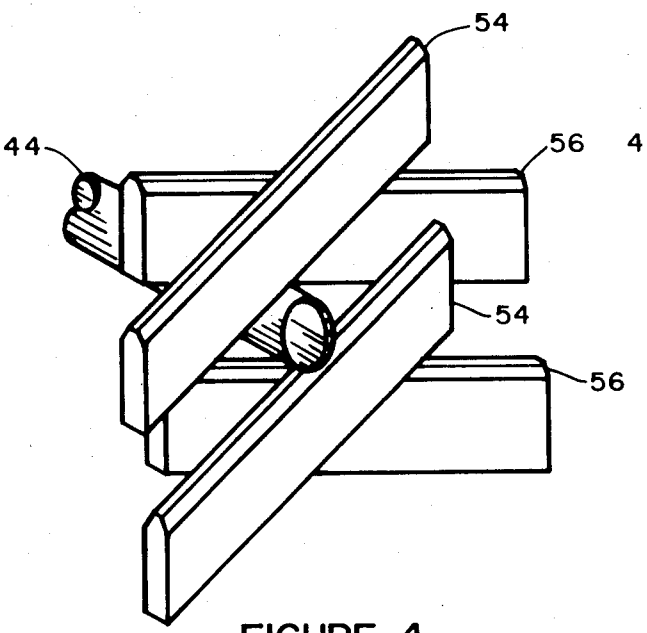
FIG. 4 is an isometric view of a portion of the hot support rack showing beveled support bars.
Figure 6:
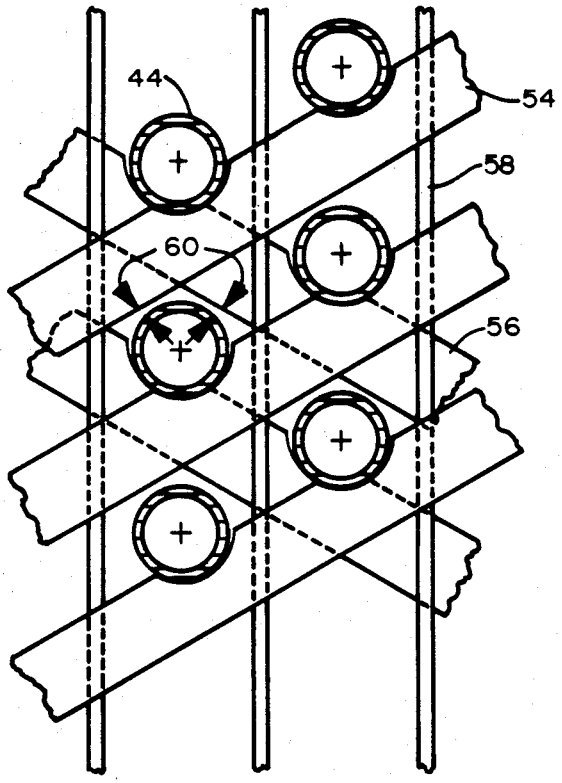
FIG. 6 is a cross-section of the in-bed head exchanger disclosing an alternate embodiment wherein the support bars are scalloped.

When the spacing between adjacent support bars 54 or adjacent support bars 56 is slightly greater than the outside diameter of a tube 44 of in-bed heat exchanger 42, clearance 60 allows free expansion of tube 44. Allowance must also be made for axial expansion of tubes 44. The upper surface of support bars 54 and support bars 56 may be contoured at least in the region where tubes 44 are supported by support bars 54 and 56. FIG. 4 shows diagonal support bars 54 and 56 in which the contour takes a beveled shape so that tubes 44 may expand axially along a relatively smooth surface. Other contoured shapes such as elliptical, semicircular or rounded, as shown in FIG. 6, also provide a relatively smooth surface along which axial expansion to tubes 44 may occur.

Support bars 54 or 56 of hot support rack 46 may be arcuately scalloped to provide a notch in which tubes 52 rest. When support bars 54 or support bars 56 are scalloped, the intermember spacing between adjacent support bars 54 or the intermember spacing between adjacent support bars 56 may be less than the outside diameter of tubes 44. With tubes 44 in place in the scalloped notches, clearance 60 is maintained to provide for thermal expansion. In a preferred embodiment, the radius of the scalloped notch is slightly greater than one-half the outside diameter of tubes 44.

Figure 8:
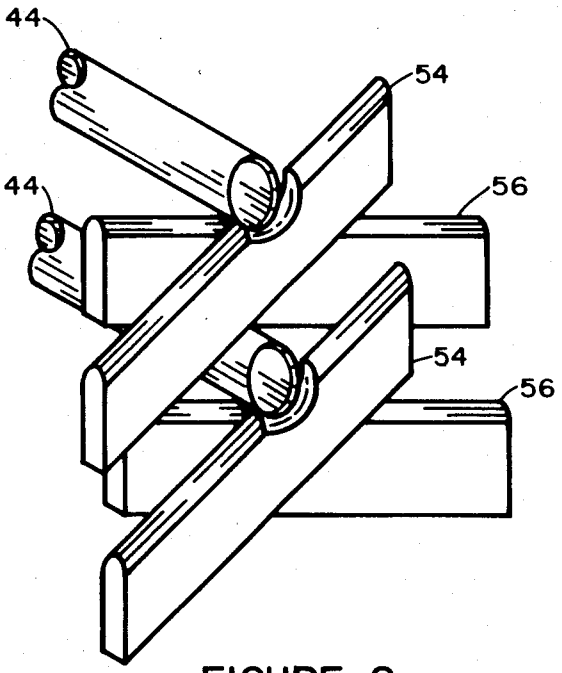
FIG. 8 is an isometric view of a portion of the hot support rack showing scalloped support bars that are also rounded.
Figure 7:
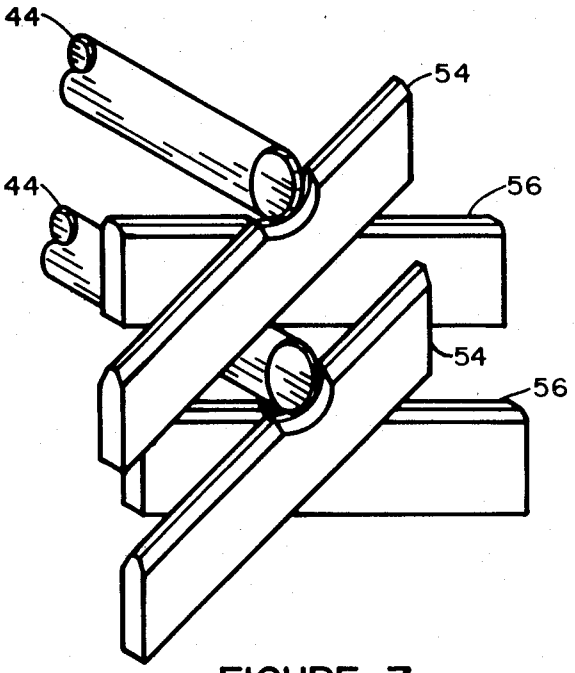
FIG. 7 is an isometric view of a portion of the hot support rack showing scalloped support bars that are also beveled.

The arcuate scalloping to accommodate a tube 44 passing through hot support rack 46 may be less than 180° on each of support bar 54 and support bar 56 supporting tube 44. In a preferred embodiment, the combined arcuate scalloping of support bars 54 and support bars 56 as viewed normal to the plane of support bars 54 and support bars 56 as shown in FIG. 6 to accommodate a tube 44 encompasses more than 180° of the circumference of a tube 44 as it passes through a quadrangular opening in hot support rack 46. This prevents tube 44 from undergoing large radial displacement such as might occur during vibration. Support bars 54 an support bars 56 of hot support rack 46 may be contoured at least in the region where tubes 44 of in-bed tubular heat exchanger 42 are supported, specifically through the region where support bars 54 and 56 are arcuately scalloped. FIG. 7 shows a contour at least in the arcuately scalloped region that is a bevel and FIG. 8 shows a contour at least in the region of the arcuate scalloping that is semicircular or otherwise rounded. The contour in the arcuately scalloped region provides a smooth surface for the thermally expanding or contracting tubes 44 to slide across as they expand or contract axially. The scalloping or contouring need only be provided on the upper surface of support bars 54 and support bars 56.

Figure 9:
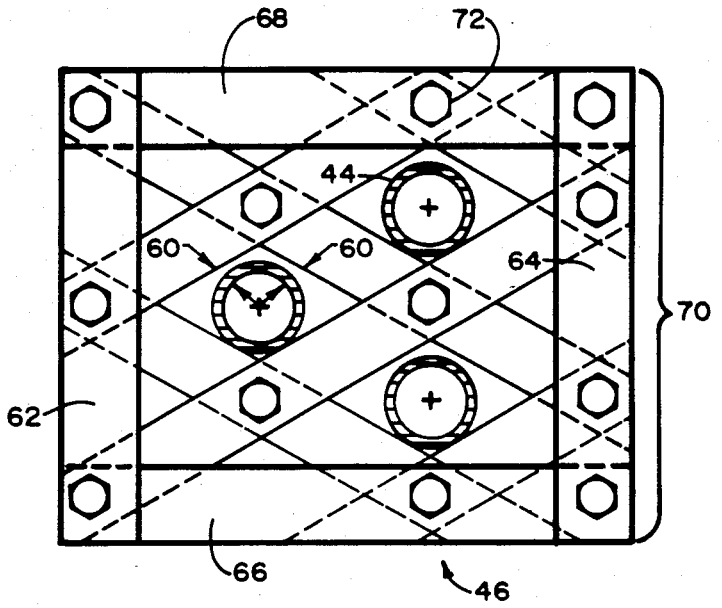
FIG. 9 is a cross-section of the in-bed heat exchanger disclosing an alternate embodiment of the hot support rack.
Figure 10:
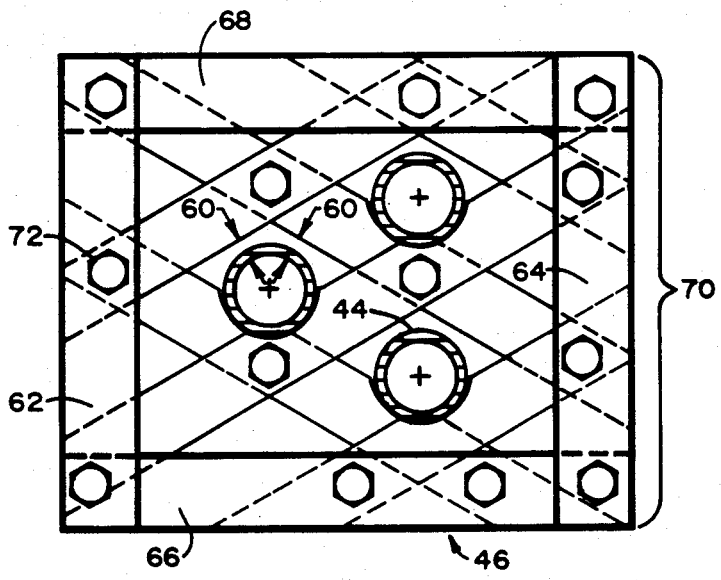
FIG. 10 is a cross-section of the in-bed heat exchanger showing scalloped support bars in the alternate embodiment of FIG. 9.

FIGS. 9 and 10 disclose an alternate embodiment of hot support rack 46 in which vertical support posts 58 passing between columns of tubes 44 to provide support and transfer the load on support bars 54 and 56 to the bed structure are replaced with a truss rack consisting of two spaced vertical members 62 and 64 and two spaced horizontal members 66 and 68 constituting a frame 70. A plurality of spaced substantially parallel support bars 54 extend diagonally upward from support member 62 to support member 64. In the upper left region of frame 70 support bars 54 will extend from vertical member 62 to horizontal member 68. In the lower right area of frame 70, support bars 54 extend from horizontal member 66 to vertical member 64.

A plurality of support bars 56 extend diagonally downward from vertical member 62 to vertical member 64. In the upper right triangular region of frame 70, support bars 56 extend from horizontal member 68 to vertical member 64. In the lower left corner of frame 70 support bars 56 extend from vertical member 62 to horizontal member 66. Each of the intersections of support bars 54 and 56 with each other as well as support bars 54 and 56 with vertical member 62, vertical member 64, horizontal member 66 and horizontal member 68 are secured such as by bolt 72. The resulting criss-cross array of support bars has quadrangular opening formed by four different bars, two adjacent support bars 54 and two adjacent support bars 56, through which tubes 44 of in-bed heat exchanger 42 pass. Tubes 44 are supported by the upper surface of support bars 54 and 56 and through the truss structure transfer the weight of tubes 44 as well as the weight of the working fluid passing therethrough and any load on tubes 44 due to the bubbling of fluidized bed through support bars 54 and 56 to vertical members 62 and 64 which carry the load to the bed support structure (not shown). Support bars 54 and 56 may be arcuately scalloped or contoured as described above. FIG. 10 shows the alternate embodiment of FIG. 9 including arcuately scalloped support bars.

The physical dimensions of support bars 54 and 56 are dependent upon many factors, including the material from which they are fabricated such as high alloy steel for high temperature applications and low alloy steel for low temperature applications, the anticipated load, the desired horizonal and vertical spacing of tubes 44, the outside diameter of tubes 44, the clearance 60 provided for thermal expansion, the angle of support bars 54 and 56 with respect to the vertical and whether support bars 54 and 56 are arcuately scalloped. For a horizontal center-to-center spacing between two tubes 44 in the same row of 15.25 centimeters (6 inches), a vertical-spacing between two tubes 44 in the same column of 10.15 centimeters (4 inches) and an outside diameter of tube 44 of 4.45 centimeters (1.75 inches) support bars 54 and 56 are 2.54 centimeters (1 inch) by 3.8 centimeters (1.5 inches) across with an intermember space of 4.77 centimeters (1.875 inches) providing a clearance between a tube 44 resting on a support bar 54 and 56 and the vertically adjacent support bar 54 and 56 of 0.32 centimeters (0.125 inches) with no arcuate scalloping in bars 54 and 56 support posts 58 are typically 1.27 centimeters (0.5 inch) by 10.2 centimeters (4 inches) in cross section. Scalloped support bars 54 and 56 would typically be 2.54 centimeters (1 inch) by 5.1 centimeters (2 inches) across.

Although the present invention has been described with respect to a preferred embodiment, it is not limited thereto. Those skilled in the art may make modifications to the preferred embodiment within the scope of the invention as claimed in the appended claims.

What is claimed is:

1. In a fluidized bed having heat exchange surface in the bed having a plurality of tubes, a rack for supporting a tubular in-bed heat exchanger for transferring heat generated in the bed region of a fluidized bed to a working fluid passing through the tubular heat exchanger comprising:

(a) a plurality of spaced substantially parallel first members extending in a first direction and forming substantially a first plane, each of the plurality of first members are arcuately scalloped to accommodate a tube;

(b) a plurality of spaced substantially parallel second members extending in a second direction forming an angle with respect to the plurality of first members and forming substantially a second plane, the second plane spaced from and substantially parallel to the first plane, the intermember space as projected normal to the first and second planes being an opening having substantially a quadrangular shape formed by adjacent first members and adjacent second members for receiving a tube of the tubular heat exchanger, the tube of the heat exchanger received in the quadrangular shape opening engaging one of the members forming the quadrangular opening such that a portion of the weight of the tube is carried thereby; and (c) a plurality of spaced third members extending substantially between the first plane and the second plane engaging the plurality of first members and the plurality of second members between adjacent tubes of the tubular heat exchanger, the weight carried by the plurality of first members and the plurality of second members transferred to the plurality of spaced third members and in turn transferred to a support therebeneath, whereby the plurality of first and second members form a criss-cross array with quadrangular openings therebetween through which the tubes of the tubular heat exchanger pass with a portion of the weight of each tube carried by one of the members of the criss-cross array the weight of each tube transferred to the criss-cross array and in turn carried to a support beneath the rack by the spaced third members.

2. A rack for supporting a tubular in-bed heat exchanger as recited in claim 1 wherein the angle between the plurality of first members and vertical is substantially equal to the angle between the plurality of second members and vertical.

3. A rack for supporting a tubular in-bed heat exchanger as recited in claim 1 wherein the scalloping is of a radius slightly greater than one half the outside diameter of the tubes of the tubular heat exchanger passing thereover.

4. A rack for supporting a tubular in-bed heat exchanger as recited in claim 1 wherein the spacing between adjacent second members is less than the outside diameter of a tube of the tubular heat exchanger and each of the plurality of second members are arcuately scalloped to accommodate a tube.

5. A rack for supporting a tubular in-bed heat exchanger as recited in claim 4 wherein the projection of the combined arcuate scalloping of the first plurality of members and the second plurality of members normal to the planes thereof is greater than 180° around a tube of the tubular heat exchanger.

6. A rack for supporting a tubular in-bed heat exchanger as recited in claim 1 wherein the plurality of first members are contoured in the region supporting a tube of the tubular heat exchanger to facilitate axial expansion and contraction of the tubes on a relatively smooth surface.

7. A rack for supporting a tubular in-bed heat exchanger as recited in claim 6 wherein the countour is a bevel.

8. A rack for supporting a tubular in-bed heat exchanger as recited in claim 6 wherein the contour is substantially semicircular.

9. In a fluidized bed having heat exchange surface in the bed having a plurality of tubes, a rack for supporting a tubular in-bed heat exchanger for transferring heat generated in the bed region of a fluidized bed to a working fluid passing through the tubular heat exchanger comprising:

(a) a plurality of spaced substantially parallel first members extending in a first direction and forming substantially a first plane, each of the plurality of first members being arcuately scalloped to accommodate a tube;

(b) a plurality of spaced substantially parallel second members extending in a second direction forming an angle with respect to the plurality of first members and forming substantially a second plane, the second plane spaced from and substantially parallel to the first plane, the intermember space as projected normal to the first and second planes being an opening having a quadrangular shape formed by adjacent first members and adjacent second members for receiving a tube of the tubular heat exchanger, the tube of the heat exchanger received in the quadrangular shaped opening engaging one of the members forming the quadrangular opening such that a portion of the weight of the tube is carried thereby; and (c) a plurality of spaced third members extending substantially between the first plane and the second plane engaging the plurality of first members and the plurality of second members between adjacent tubes of the tubular heat exchanger, the weight carried by the plurality of first members and the plurality of second members transferred to the plurality of spaced third members and in turn transferred to a support therebeneath, whereby the plurality of first and second members form a criss-cross array with quadrangular openings therebetween through which the tubes of the tubular heat exchanger pass with a portion of the weight of each tube carried by one of the members of the criss-cross array, the weight of each tube transferred to the criss-cross array and in turn carried to a support beneath the rack by the spaced third members.

10. A rack for supporting a tubular in-bed heat exchanger as recited in claim 9 wherein the scalloping is of a radius slightly greater than the radius of the tubes of the tubular heat exchanger passing thereover.

* * * * *